United States Patent [19]

Newton et al.

[11] 4,151,848

[45] May 1, 1979

[54] TOBACCO WITH REDUCED NICOTINE CONTENT DUE TO MICROBIAL TREATMENT

[75] Inventors: Richard P. Newton, Louisville, Ky.; John N. Jewell; Vernon L. Geiss, Floyd Knobs, Ind.; Lawrence E. Gravely, both of Louisville, Ky.

[73] Assignee: Brown & Williamson Tobacco Corporation, Louisville, Ky.

[21] Appl. No.: 787,242

[22] Filed: Apr. 13, 1977

Related U.S. Application Data

[62] Division of Ser. No. 632,863, Nov. 17, 1975, Pat. No. 4,037,609.

[51] Int. Cl.[2] ..... A24B 15/02

[52] U.S. Cl. ..... 131/17 R; 131/140 B; 131/141

[58] Field of Search ..... 131/17 R, 17 A, 17 AB, 131/17 AC, 17 AD, 17 AE, 140 R, 140 B, 140 C, 141, 142 R, 142 A, 143, 144, 8 R, 15 C

[56] References Cited

U.S. PATENT DOCUMENTS

| | | | |
|---|---|---|---|
| 2,644,462 | 7/1953 | Frankenburg | 131/141 |
| 3,132,651 | 3/1964 | Kiefer | 131/141 |
| 3,240,214 | 3/1966 | Bavley et al. | 131/141 |
| 3,256,888 | 6/1966 | de la Burde | 131/141 |
| 3,256,889 | 6/1966 | de la Burde | 131/141 |
| 4,651,816 | 3/1972 | Neurath et al. | 131/17 |

FOREIGN PATENT DOCUMENTS

| | | | |
|---|---|---|---|
| 665972 | 6/1936 | Fed. Rep. of Germany | 131/141 |
| 1692942 | 5/1971 | Fed. Rep. of Germany | 131/141 |

OTHER PUBLICATIONS

Tafuchi; T. J., Agr. Soc., Japan, vol. 28, pp. 806–810, (1954).

Cousserat; J., Annales S.E.I.T.A.-D.E.E., Sect. 2, No. 10, pp. 155–172 (1973).

Bailey; E. M., et al., Conn. Agri., Expt. Station Bulletin, vol. 295, pp. 338–351 (1928).

Gherna; R. L., "The Bacterial Oxidation of Nicotine," Dissertation, Univ. Southern California (1964).

Deppe; K., "Research into the Oxidative Decomposition of Nicotine" by Psuedomonas Convexa, Dissertation Univ. of Hamburg (1964).

Hylin; J. W., Arch. Brochem. Biophys., vol. 83, pp. 528–537 (1959).

Wada; E., et al., Science, vol. 117, pp. 152–153 (1953).

Wada; E., et al., J. Am. Chem. Soc., vol. 76, pp. 155–157 (1954).

Holmes; P., et al., J. Biol. Chem., vol. 247, No. 23, pp. 7622–7627 (1972).

Henz; C. F., Tobacco Science, vol. 9, pp. 98–101 (1965).

Henz; C. F., et al., Tobacco Science, vol. 11, pp. 11–13 (1967).

Tabuchi; T., J. Agr. Soc., Japan, vol. 29, pp. 219–225 (1954).

*Primary Examiner*—Robert W. Michell

*Assistant Examiner*—V. Millin

*Attorney, Agent, or Firm*—William J. Mason; Charles G. Lamb

[57] ABSTRACT

A process for the reduction of the nicotine content of tobacco by microbial treatment is disclosed. Tobacco is subjected, under controlled conditions, to the action of a microorganism effective to degrade nicotine through a biochemical reaction in which, inter alia, 3-succinoylpyridine is formed. Prior to subjecting the tobacco to the action of the microorganism, the tobacco is steamed to increase its moisture content. Tobaccos with lowered nicotine content but no mass loss result from this process following short treatment periods. Also, tobacco treated in accordance with this process, when incorporated into a tobacco smoking product, produces a mild smoke, having a reduced nicotine content. However, there is no loss of desirable flavor, taste and smoking properties.

3 Claims, 2 Drawing Figures

TOBACCO WITH REDUCED NICOTINE CONTENT DUE TO MICROBIAL TREATMENT

This is a division of application Ser. No. 632,863 filed Nov. 17, 1975 now U.S. Pat. No. 4,037,609.

FIELD OF INVENTION

The present invention pertains to a process of reducing the nicotine content of tobacco by treating the tobacco with cultures of microorganisms. More specifically, the present invention pertains to an improved process for treating tobacco by subjecting it to the action of particular microorganisms, under controlled conditions, whereby the nicotine content of the tobacco is reduced in a relatively short time. The process is effective to reduce the nicotine content of tobacco without substantially reducing the perceived strength of smoke generated by smoking articles produced from the tobacco. However, there is a reduction in irritating properties of smoke which is generated from tobacco treated by the process of the present invention.

BACKGROUND OF THE INVENTION

For various reasons, it is often desirable to reduce the nicotine content of tobacco. For example, in recent years, low nicotine content "mild" cigarettes have gained substantial consumer acceptance.

There are numerous techniques available for reducing the nicotine content of tobacco. However, most of these techniques result in the removal of other tobacco ingredients along with the nicotine. The removal of other ingredients adversely affects desirable flavor and taste properties, or other desirable smoking qualities. Thus, there is a need for techniques which are effective to selectively reduce the nicotine content of tobacco without deleteriously modifying its desirable smoking properties.

The microbial treatment of the present invention involves the use of microorganism cultures which are specific to nicotine whereby the nicotine content of tobacco may be substantially reduced without producing any substantial effect on other components of the tobacco. While the nicotine content of tobacco is reduced, the organoleptic properties attributed to smoke generated from the tobacco are generally maintained. However, after treatment, a milder smoke is produced.

The art of tobacco fermentation has been practiced for many years in the production of cigars, chewing tobacco, and snuff. However, treatment of cigarette tobaccos by these processes is not practical because of the long times, usually days or weeks, required for completion of fermentation. These fermentation techniques also typically result in significant losses of tobacco mass, often as much as 20% to 25% of the starting dry weight.

Treatment of nicotine, including nicotine obtained from plant sources, with microorganisms effective to degrade the nicotine through a biochemical mechanism in which 6-hydroxy nicotine is formed, is known in the art. Such a technique is disclosed in U.S. Pat. No. 3,664,176. While such microorganisms are effective to degrade relatively concentrated nicotine, their use in processing tobacco during production of smoking articles, particularly cigarettes, has not been economically feasible. An extremely long contact time between the tobacco and these microorganisms is required to achieve any significant nicotine reduction under any practical operating conditions.

In accordance with the present invention, the nicotine content of tobacco can be significantly, economically and selectively reduced without adversely affecting the tobacco. The process does not increase tobacco processing time by impractical amounts, and does not involve any significant additional energy input, since the microorganisms derive their energy almost solely from nicotine contained within the tobacco. In addition, the technique of the present invention does not result in any significant loss of tobacco mass.

The present invention provides a process for the denicotinization of tobacco by inoculating the tobacco with a particular group of microorganisms, under proper conditions of temperature, moisture and pH. The microorganisms suitable for use in the present invention are those which degrade nicotine through a biochemical reaction in which 3-succinoylpyridine, as well as 6-hydroxy-3-succinoylpyridine and other byproducts, are formed. The denicotinization process may be readily incorporated into conventional techniques for processing tobacco during manufacture of smoking products.

SUMMARY OF THE INVENTION

The present invention provides a process for reducing the nicotine content of tobacco which comprises first subjecting tobacco to steam for a sufficient period of time to bring the moisture level of the tobacco to at least 15% by weight. Subsequently, the tobacco is inoculated with a microorganism effective to degrade nicotine through a biochemical mechanism in which 3-succinoylpyridine is formed. After adding the microorganism to the tobacco, the moisture level must be maintained at a level of at least 50% by weight, based on the total weight of the tobacco and water.

Subsequent to the addition of the microorganism to the tobacco, the temperature must be controlled so that it is maintained between about 20° C. and about 45° C. while the initial pH of the mixture is maintained between about 5 and about 8. The microorganism is kept in contact with the tobacco for a sufficient period of time for the microorganism to act on the nicotine contained in the tobacco. The nicotine content of the tobacco is thereby reduced by degradation to, *inter alia,* 3-succinoylpyridine.

The present invention provides a technique whereby substantial reductions in nicotine content may be obtained with relatively short treatment periods. By using relatively short treatment periods, no substantial tobacco mass loss occurs.

Tobacco treated with the process of the present invention produces a mild, pleasant tasting smoke. The pleasant taste of smoking products containing tobacco treated by the process of the present invention may be due, in part, to the presence of flavor altering amounts of nicotine degradation products, particularly 3-succinoylpyridine and 6-hydroxy-3-succinoylpyridine.

The process of the present invention is particularly useful for treating burley tobacco. Burley normally has a relatively high nicotine content and produces a rather harsh smoke. Conventionally, burley tobacco is treated with casing compositions to reduce harshness. Treatment by the process of the present invention not only reduces the nicotine content, but reduces harshness to the extent that burley may be employed in smoking products without casing.

DESCRIPTION OF PREFERRED EMBODIMENTS

Figure 1:
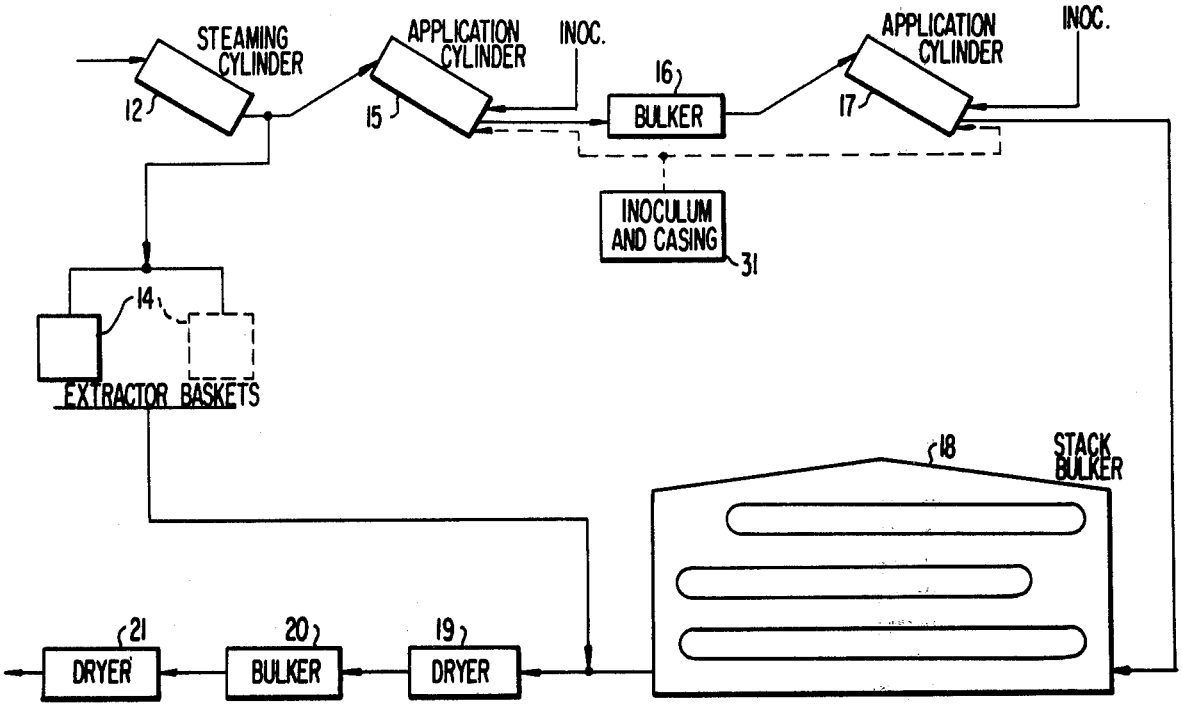
FIG. 1 is a schematic diagram illustrating a preferred embodiment of the microbial treatment of the present invention.

Pure culture isolates of bacterial effective in degrading nicotine through a biochemical mechanism in which 3-succinoylpyridine is formed, which are suitable for use in the present invention, can be obtained by culture enrichment techniques. Three bacteria species, of the type suitable for use in the present process, have been obtained from cigar tobacco.

Puerto Rican cigar tobacco (500 grams) was adjusted to an 80% moisture level with water, bulked tightly, enclosed in plastic, and allowed to incubate over night an approximately 25° C. Sampling for alkaloids in the tobacco and rebulking took place after 18 hours. The incubation and rebulking cycle continued for a few days until the alkaloid level in the tobacco was very low.

After a few days, five grams of the treated cigar tobacco was added to a flask of nicotine broth and incubated at 30° C. with shaking. The nicotine broth comprised 0.02 g. $FeSO_4$, 4 ml. nicotine, 2.0 g. $KH_2PO_4$, 5.0 g. KCl, 0.2 g. $MgSO_4$, 0.1 g. yeast extract, and one liter of water to make a broth having a pH of 6.8.

Subsequent alkaloid analysis of the nicotine broth showed that the nicotine was decomposed. Nicotine was added to the broth to return the nicotine level to 4 mg./ml. This in turn was depleted. Fresh nicotine broth was inoculated from the first flask and again, nicotine depletion occurred. Fresh media with additional nicotine were used through several successive transfers.

Materials from the flasks of inoculated nicotine broth were streaked on nicotine agar, having the same composition as the nicotine broth, except for the addition of 1.5% agar, and incubated at 30° C. The most vigorous colonies of bacteria which developed on the nicotine agar were restreaked several times to obtain pure strains.

From the original colonies, three strains of bacteria were obtained, identified, and deposited with the U.S. Dept. of Agriculture (at the Northern Regional Research Laboratory, Peoria, Ill.). One strain, referred to herein as isolate *Cellulomonas sp.* (NRRL B-8063), had irregular colonies. Another referred to herein as isolate *Pseudomonas putida* (NRRL B-8062), had smooth milkyd colonies, and the third, referred to herein as isolate *Pseudomonas putida* (NRRL B-8061), had smooth white colonies. Strains NRRL B-8061 and NRRL B-8062 shows a more aggressive nicotine degrading tendency than strain NRRL B-8063. *Pseudomonas putida* (NRRL B-8061) is the preferred microorganism for use in the process of the present invention, although *Psuedomonas putida* (NRRL B-8062) is very similar in most capabilities. The morpholobical and biochemical characteristics of *Pseudomonas putida* (NRRL B-8061 and NRRL B-8062) and *Cellulomas sp.* (NRRL B-8063) are shown in Tables I, II and III, respectively.

While strains NRRL B-8061, B-8062 and B-8063 have been described in detail, the process of the present invention is not limited to the use of these specific organisms. Any microorganisms which are effective to degrade nicotine through a biochemical mechanism in which 3-succinoylpyridine is formed may be employed. Of course, the microorganisms may be effective to produce nicotine degradation products other than 3-succinoylpyridine and it should not be implied that this is the sole degradation product which is produced.

To be suitable for use in the process of the present invention, it is only essential that the microorganisms be effective to degrade nicotine to 3-succinoylpyridine; it is irrelevant if other degradation products also are produced. Microorganisms which degrade nicotine without producing any significant quantities of 3-succinoylpyridine, such as those which degrade nicotine to 6-hydroxynicotine, are not suitable for use in the present invention.

TABLE I

MORPHOLOGICAL AND BIOCHEMICAL CHARACTERISTICS OF *PSEUDOMONAS PUTIDA* (NRRL B-8061)

A. MORPHOLOGY

Rods, oval to short in shape, 0.8–1.0 microns (diameter) by 1.0–2.2 microns (length); predominantly coccoidal. Form pairs and longer filaments.

Colony Form:

Nutrient Agar: Opalescent, light tan or cream colored, flat smooth edges.

Peptone Yeast Extract Agar: Appearance much like that on Nutrient Agar; accompanied by the formation of a diffusible yellow pigment which fluoresces under ultraviolet light. This pigment produced well in media with glucose present.

Nicotine Agar: Filiform, opaque, pearl-gray, butyrous, glistening.

Brain Heart Infusion Agar: Circular, umbonate, rugose, undulate, glistening, opaque, pearl-gray.

Growth type in static Brain Heart Infusion Broth: Turbid, membranous surface growth, flocculent sediment, heavy growth.

Gram negative

Motile by three or more polar flagella.

B. PHYSIOLOGY

Obligate aerobe. Strongly aerotactic.

Optimum growth: 25°-30° C. Range: 12°-37° C.

Nitrate reduced to nitrite, no gas formed.

Tellurite Reduction: negative.

Growth with Benzoic acid as substrate. Growth with citrate as sole carbon source, forming fluorescent yellow pigment.

No growth on trehalose, or with mandelic acid, 2-hydroxypyridine or pyridine.

Hydrolysis of arginine, positive. Gelatin, starch, cellulose, casein, and urea not hydrolyzed.

Lactic acid produced.

Oxidase produced.

Ammonia produced.

Acid and hydrogen sulfide not produced.

Catalase present.

Acetylmethyl-carbinol and indole not present.

Litmus milk: Alkaline, then reduced.

No hemolysis of blood agar.

Acid but no gas from: Adonitol, arabinose, cellobiose, dulcitol, fructose, galactose, mannose, melibiose, raffinose, rhamnose, salicin.

Growth with no acid or gas production with lactose, sucrose, maltose, glucose, xylose, dextrine, glycerol, mannitol, and inositol.

Growth but no phenazine pigment production on Kings medium A. Growth and fluorescent pigment on Kings medium B.

Grows with nicotine and nicotinic acid as sole sources of carbon. Ultraviolet spectrum of the growth liquid at time of pigmentation shows accumulation of 2, 5-dihydroxypyridine with both substrates.

GC ratio: Melting point method: 62.5. CsCl density gradient centrifugation: 63.2.

Pathogenicity: Non-pathogenic to guinea pigs when fed orally or injected intraperitoneally.

Source: Tobacco.

TABLE II

MORPHOLOGICAL AND BIOCHEMICAL CHARACTERISTICS OF *PSEUDOMANAS PUTIDA* (NRRL B-8062)

A. MORPHOLOGY

Rods, oval to short in shape, 0.8–1.0 microns (diameter) by 1.0–2.2 microns (length); predominantly coccoidal. Form pairs and longer filaments.

Colony Form:

Nutrient Agar: Opalescent, light tan or cream colored, flat smooth edges.

Peptone Yeast Extract Agar: Appearance much like that on Nutrient Agar; accompanied by the formation of a diffusible yellow pigment which fluoresces under ultraviolet light. This pigment produced well in media with glucose present.

Nicotine Agar: Filiform, opaque, pearl-gray, butyrous, glistening.

Brain Heart Infusion Agar: Circular, umbonate, rugose, undulate, glistening, opaque, pearl-gray.

Growth type in static Brain Heart Infusion Broth: Turbid, membranous surface growth, flucculent sediment, heavy growth.

Gram negative

Motile by three or more polar flagella.

B. PHYSIOLOGY

Obligate aerobe. Stongly aerotactic.

Optimum growth: 25°–30° C. Range: 12°–37° C.

Nitrate reduced to nitrite, no gas formed.

Tellurite Reduction: negative.

Growth with Benzoic acid as substrate. Growth with citrate as sole carbon source, forming fluorescent yellow pigment.

No growth on trehalose, or with mandelic acid, 2-hydroxypyridine or pyridine.

Hydrolysis of arginine, positive. Gelatine, starch, cellulose, casein, and urea not hydrolyzed.

Lactic acid produced.

Oxidase produced.

Ammonia not produced.

Acid and hydrogen sulfide not produced.

Catalase present.

Acetylmethyl-carbinol and indole not present.

Litmus milk: Alkaline, then reduced.

No hemolysis of blood agar.

Acid but no gas from: Adonitol, arabinose, Cellobiose, dulcitol, fructose, galactose, mannose, melibiose, raffinose, rhamnose, salicin.

Growth with no acid or gas production with lactose, sucrose, maltose, glucose, xylose, dextrine, glycerol, mannitol, and inositol.

Growth but no phenazine pigment production on Kings medium A. Growth and fluorescent pigment on Kings medium B.

Grows with nicotine and nicotinic acid as sole sources of carbon. Ultraviolet spectrum of the growth liquid at time of pigmentation shows accumulation of 2, 5-dihydroxypyridine with both substrates.

GC ratio: Melting point method: 61.0. CsCl density gradient centrifugation: 62.0.

Pathogenicity: Non-pathogenic to guinea pigs when fed orally or injected intraperitoneally.

Source: Tobacco.

TABLE III

MORPHOLOGICAL AND BIOCHEMICAL CHARACTERISTICS OF *CELLULOMONAS SP.* (NRRL B-8063)

A. MORPHOLOGY

Cells are thin, bent or almost vibroid rods with a diameter of 0.5–0.7 microns and length of 1.5–2.5 microns.

Colony Form:

Nutrient Agar: Small, yellow, flat, butyrous, and with smooth edges.

Peptone Yeast Extract Agar: Similar appearance to that on nutrient Agar. No exocellular pigments were formed when growing on a variety of media, including nicotine.

Nicotine Agar: Filiform, opaque, pearl-gray, membranous, dull.

Brain Heart Infusion Agar: Circular, umbonate, contoured, undulate, dull, opaque, pearl-gray.

Growth type in static Brain Heart Infusion Broth: Turbid, viscid, ringed, moderate growth.

Gram positive when young, variable as stationary growth is reached.

Motile by tumbling action. Cells possess 1 or 2 polar flagella.

B. PHYSIOLOGY

Facultative anaerobe; obligate aerobe when nitrate is present.

Optimum growth: 28°–30° C. Range: 15°–37° C.

Reduces nitrate to nitrite and actively produces nitrogen gas.

Grows with nicotine and benzoic acid as sole carbon sources. No pigment formed. Spectral scans of growth liquor from nicotine showed no evidence of dipyridols.

No growth with mandelic acid, 2-hydroxypyridine, or pyridine.

No hydrolysis of gelatin, starch, cellulose, casein, urea, or arginine.

Grows with citrate as sole carbon source.

Tellurite reduction: negative.

No production of hydrogen sulfide.

Lactic acid, oxidase and ammonia produced.

Catalase, positive.

Indole present, weak.

Acetylmethyl-carbinol not present.

Litmus milk, alkaline, then reduced.

No pigment on Kings A or B medium.

Growth with no acid or gas production on glucose, sucrose, maltose, fructose, galactose, raffinose, xylose, salicin, adonitol, glycerol, and inositol.

No growth on lactose.

Acid but no gas from: arabinose, cellobiose, mannose, melibiose, rhamnose, dextrin, dulcitol, and mannitol.

No hemolysis of blood agar.

GC ratio: Melting point method, 69.2. CsCl density gradient centrifugation, 68.9.

Pathogenicity: Non-pathogenic to guinea pigs when fed orally or injected intraperitoneally.

Source: Tobacco.

Figure 2:
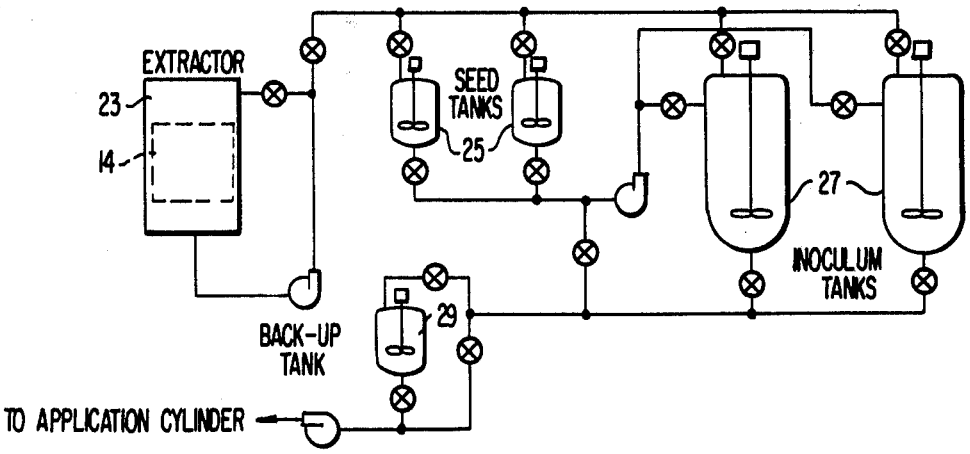
FIG. 2 is a schematic diagram illustrating a preferred technique for preparing inoculum for use in the process illustrated by FIG. 1.

A preferred embodiment of the process of the present invention is illustrated in FIGS. 1 and 2. With reference to FIG. 1, tobacco, such as burley strip is introduced into steaming cylinder 12 where the strip is subjected to the action of steam. The tobacco is steamed until the moisture is brought to at least 15% by weight, and preferably to about 25%.

This preliminary steaming step permits the nicotine reduction treatment to proceed more rapidly at lower moisture levels than would otherwise be practical. The reason for this is not known, but it is believed that preliminary steaming somehow permits the microorganism and the nicotine in the tobacco to more rapidly come into contact.

At high moisture contents, in large scale operations, changes in the moisture level of as small as 1% or 2% can amount to many pounds of water. Since most of the added water must subsequently be removed from the tobacco, it is apparent that even relatively small reductions in the moisture level are of great economic benefit in commercial practice. Furthermore, rapid reduction in nicotine content is obviously economically beneficial, particularly since long tobacco-microorganism contact times tend to result in loss of tobacco mass.

Subsequent to steaming, 10% of the strip goes to the extractor baskets 14 to supply the broth media for growing the culture. Growth of the culture will be described in greater detail subsequently, with reference to FIG. 2.

The main tobacco stream passes from steaming cylinder 12 through a first inoculum application cyliner 15, in which a portion of the bacteria is applied to the tobacco strip. From about 40% by weight to about 70% by weight, and preferably from about 50% to about 60%, of the total inoculum conveniently can be applied in the first inoculum application cylinder. Application of the aqueous inoculum is effective to bring the moisture level of the tobacco up to at least 40% by weight, and preferably 50% by weight, based on the total weight of the tobacco-water mixture.

From the first application cylinder, the strip passes to intermediate bulker 16 where it is held for a short period of time, *e.g.*, 2 to 10 minutes. The intermediate bulker allows time for water to be absorbed by the strip before it is passed to the second inoculum application cylinder 17, where the remainder of the bacteria is applied. This second application of acqueous inoculum brings the moisture level of the tobacco to at least 50% by weight, and preferably to at least about 65% by weight, e.g., from about 65% to about 75% by weight. The total amount of bacteria applied should be at least $1\times10^7$ cells per gram, based on the dry weight of the tobacco.

From second appliction cylinder 17, the inoculated tobacco strip is passed to stack bulker 18. Bulking involves nothing more than a static treatment, under aerobic conditions, at the desired moisture, temperature and Ph levels. At times, intermittent mixing can be beneficial.

The tobacco strip is bulked for about 1 to about 10 hours, *e.g.*, about 6 hours, to allow time for the microorganism to substantially reduce the alkaloids content of the tobacco. Typically a reduction of about 50% by weight is achieved. In stack bulker 18, preferably the moisture level is maintained at about 65–75%, the initial pH at 6 to 7.5, and the temperature from 27° C. to 32° C.

To maintain the initial pH within the desired limits, it may be necessary to add a small amount of an alkaline material, such as an ammonium hydroxidde or sodium hydroxide solution, to the tobacco. However, many tobaccos will inherently have a pH within the desired range and will require no adjustment.

The ten percent side stream of tobacco, previously passed to extractor baskets 14, is returned to the total tobacco stream, after extraction, when the tobacco is passed from stack bulker 18 to dryer 19. Subsequent to extraction, the side stream tobacco has an alkaloids content of about 0.7%.

The tobacco strip is dried in two stages (dryers 19 and 21) separated by an intermediate bulker 20 to insure moisure equilibrium. After the last drying step the treated tobacco strip goes into another bulker and is returned to normal tobacco processing flow.

Larger or smaller reductions in tobacco nicotine concentration can be achieved by altering the treatment parameters. Less nicotine removal is normally achieved by using shorter stack bulking times. Greater nicotine removal can be accomplished by concentrating the inoculum prior to application to the tobacco, by using longer stack bulking times, or by combinations of both.

A preferred inoculum build-up technique, to obtain the inoculum which is added at application cylinders 15 and 17, is illustrated in FIG. 2. The inoculum build up starts with the preparation of broth at extractor 23. The strip is placed in extractor baskets 14 and hoisted into extractor 23. Hot water is circulated through extractor 23, which is in the form of a pressure cooker, until the alkaloid level of the water reaches 1.5 mg./ml. The broth is then pumped from the extractor to the seed tanks 25 and the inoculum tanks 27.

The nicrobial culture is built up in stages. The first stage is done by flask culture in nutrient containing tobacco broth. Cultures of the microorganism are transferred into several six liter flasks containing tobacco broth and nutrients, and allowed to grow to maturity in about 48 hours. These flasks are then used to charge the tobacco broth containing seed tanks 25. Seed tanks 25 have approximately 3% the volume of inoculum tanks 27.

Cultural build up in the seed tanks takes about five to eight hours. When completed, the inoculum tanks 27 are charged from the seed tanks and again allowed a five to eight hour growth period before they are ready to add to the tobacco strip at application cylinders 15 and 17. Inoculum tanks 27 are designed to supply inoculum to the application cylinders over a period of about four hours. Back-up tank 29 provides a source of extra inoculum should it be needed.

During inoculum build up, the broth should be subjected to aeration and agitation. Proper control of pH results in increased inoculum activity; the broth should have an initial pH of between about 5 and 8, and preferably between about 6.2 and 7.8. In addition, the broth should be maintained between about 10° C. and 45° C., and preferably between about 28° C. and 32° C.

The broth should have an initial nicotine concentration of at least 0.1 mg. per ml., and preferably at least 1.5 mg. per ml. Of course, the broth should not contain nicotine concentrations of more than amounts which will be toxic to the microorganisms. Concentrations of nicotine greater than about 12 mg. per ml. normally substantially slow microorganism growth.

It is best to use the inoculum as soon as it is ready to avoid loss in activity. The inoculum has the highest activity at the point when nicotine is substantially depleted from the broth, i.e., a broth nicotine content of about 0.2 mg. per ml. Oxygen demand of the microorganism is highest when the nicotine is being reduced. Thus, dissolved oxygen content is a good indicator of when nicotine is substantially depleted and the inoculum is ready for application.

The process of the present invention is compatible with the use of conventional tobacco process techniques. When the process of the present invention is used in connection with normal tobacco processing, the normal casing and subsequent drying step can be combined into the microbial treatment. Specifically, the casing material can be added with the microbial inoculum prior to bulking. Such a technique is illustrated in FIG. 1, wherein inoculum and casing are combined at 31 and added to application cylinder 15 and/or application cylinder 17. Such a technique eliminates the subsequent casing and drying steps, and is thus economically advantageous for this reason.

As is well known in the art, casing solutions, containing such materials as sugars, syrups, licorice, honey, chocolate, balsams, etc. are added to burley or blended leaf tobaccos, as flavorants and to mellow and lessen the harshness of such tobaccos. In some situations, casing of tobacco treated by the process of the present invention may not be required or desirable. For example, normally harsh burley tobacco is mellowed by the microbial treatment and thus when so treated can be incorporated into smoking products without being cased.

The process of the present invention is an improvement over the technique disclosed in application Ser. No. 632,804 (filed on the same date as the present application by Geiss, Gregory, Newton and Gravely), now U.S. Pat. No. 4,038,993 which is incorporated herein by reference. A technique for maximizing culture activity is disclosed in application Ser. No. 632,857 (filed on the same date as the present application by Gravely, Geiss and Newton), now U.S. Pat. No. 4,011,141 which is also incorporated herein by reference.

The process of the present invention is effective to reduce the nicotine content of tobacco and tobacco parts. Various forms of tobacco, in varying degrees and stages of curing, may be employed. For example, the process may be employed with unredried flue-cured or burley strips, redried flue-cured or burley strips, burley stems, flue-cured stems, manufacturing fines, stocks, shredded tobacco, and mixtures thereof. The process may also be employed with nicotine containing materials used to produce products such as tobacco substitutes and reconstituted tobacco.

Tobacco treated by the process of the present invention is highly suitable for use in the manufacture of tobacco smoke products, such as cigarettes. The tobacco is uniquely well suited for use in tobacco products in which a low nicotine content is desired. Smoke from tobacco treated in accordance with the process of the present invention, when incorporated into a tobacco smoking product, gives reduced nicotine deliveries, as well as desirable flavor and taste properties. The presence of minor amounts, such as amounts inherently present in tobacco treated by the process of the present invention, of nicotine degradation products, particularly 3-succinoylpyridine and 6-hydroxy-3-succinoylpyridine, are effective to impart desirable smoking flavor and taste properties.

The process of the present invention may be further illustrated by the following specific examples. The examples are intended to merely illustrate specific embodiments, and are in no way limiting.

EXAMPLE 1

PREPARATION OF INOCULUM

Nicotine Agar and Broth

Nicotine agar was prepared according to the following formula:

| | |
|---|---|
| Nicotine | 4.0 ml |
| $FeSO_4$ | 0.025 gm |
| $KH_2PO_4$ | 2.0 gm |
| KCl | 5.0 gm |
| $MgSO_4$ | 0.25 gm |
| Yeast Extract | 0.1 gm |
| Agar | 15.0 gm |
| Distilled or Deionized Water | to Make 1 liter |
| Final pH 6.8 | |

The medium is sterilized in an autoclave for 15 minutes at 15 psig and 121° C. Nicotine is usually added to the medium just prior to use. A broth of the above medium is prepared by omitting the addition of agar.

Tobacco-Nicotine Broth

An extract of burley tobacco is prepared as follows: 100 grams of burley tobacco is mixed with 1000 mls of water and cooked in an autoclave for 25 minutes at 15 psig and 121° C. The resultant effluent liquor is removed and the volume adjusted to the original amount. An equal volume of an aqueous broth containing 0.05 gm. $FeSo_4$, 4.0 gm. $KH_2PO_4$, 10.0 gm, KCl, 0.5 gm. $MgSO_4$ and 0.2 gm. yeast extract is added to the burley tobacco extract. The medium is sterilized in an autoclave for 15 minutes at 15 psig and 121° C. Just prior to use, nicotine is added to give a final nicotine concentration of 4.0 mg./ml. Flue-cured tobacco can be used successfully in this medium in place of burley tobacco.

Tobacco Extract Broth

Tobacco extract broth is prepared in the same manner as the burley extract used in the tobacco-nicotine broth. Water may or may not be added, depending upon the final nicotine concentration desired.

Broth Inoculation

The microorganisms, such as strain NRRL B-8061, are incubated on agar slants for 24 to 72 hours at 30° C. Liquid media, for example tobacco-nicotine broth, are inoculated with a sterile water wash from slants which have been diluted to an optical density of 0.5 as read at 650 mu on a spectrophotometer. A 1% (v/v) inoculum rate of the standardized suspension is added to one of the broth media for culture propagation. Optimum growth is achieved by employing rotary agitation for 24 to 48 hours at 30° C. and 220 rpm.

EXAMPLE 2

A tobacco extract broth charge was prepared by placing the appropriate amount of burley strip tobacco (approximately 15 lbs. dry weight) in a wire extractor basket which was placed in an extractor. Hot water (85–90° C.) (approximately 250 to 300 lbs) was then recirculated through the wire basket containing the tobacco until the alkaloid level reached 1.5 mg./ml. A stainless steel cylindrical tank was charged with 200 lbs. of the tobacco extract broth.

*P. putida* (NRRL B-8061) inoculum was prepared in tobacco extract shake flask cultures as described in Example 1. Twelve pounds of inoculum was used to charge the 200 lbs of tobacco extract broth in the tank. The tank contents were adjusted to a pH of 6 prior to inoculation. Following inoculation, the tank contents were agitated at 111 rpm using an internal marine blade mounted on a stainless shaft driven by a "LIGHTIN Mixer" (Model ND1A). Aeration, at the rate of 1.08 cu. ft. of air per minute was achieved with a multiple outlet circular stainless tubing placed at the tank bottom. The tank was maintained at a temperature between 25–30° C.

After 9 hours growth the nicotine content of the tobacco extract broth inoculum was 0.09 mg./ml. At this point a spraying cylinder was used to apply the *P. putida* (NRRL B-8061) (82 lbs.) inoculum to 45 lbs. of steamed burley strip until the moisture level of the tobacco reached 68–70%. The sprayed tobacco was bulked with a bed depth of approximately 6 inches for five hours at 25° C. while covered with a plastic sheet. The tobacco was dried on an apron type redrier to a moisture level of 14.5%. As a result of this treatment the alkaloid content of the tobacco was lowered from 3.50% to 1.65%. Weighing data showed that no mass loss occurred during this process.

EXAMPLE 3

A sample of burley strip blend was passed through a steaming cylinder to bring the strip moisture to 25%. *P. putida* (NRRL B-8061) inoculum, prepared as described in Example 2, was added to the steamed tobacco at a rate equal to two times the tobacco dry weight. Additional water was also sprayed on the tobacco to bring the moisture level to 75%. A second sample was prepared in the same manner as the first, except the steaming step was omitted. Sufficient water was added with the inoculum to this sample to bring the moisture content to the target 75%. Following inoculation, the tobacco was bulked as described in Example 2. Results from monitoring the total alkaloids of the tobacco sample are shown below:

| Bulking Time (hrs) | | % Total Alkaloids Steamed Tobacco | % Total Alkaloids No Steam |
|---|---|---|---|
| 0 | (start) | 3.2 | 3.2 |
| 1 | | 1.86 | 2.01 |
| 2 | | 1.99 | 2.31 |
| 3 | | 1.90 | 2.56 |
| 4 | | 1.61 | — |
| 5 | | 1.61 | — |
| 19 | | 1.16 | 1.21 |

EXAMPLE 4

To illustrate optimum culture growth, *P. putida* (NRRL B-8061) was grown in burley nicotine infusion broth (250 ml/500 ml flask) as described in Example 1, for 22 hours at 30° C. with rotary agitation. This culture was used to inoculate an 8 liter sterilized burley blend extract broth at 5% (v/v) rate contained in a 14 liter fermentor jar attached to a New Brunswick Scientific Microferm Fermentor (Model No. MF-214). The broth was subjected to agitation at 600 rpm and aeration at the rate of 8000 cc air per min at 30° C. Data shown below indicate the positive rise in population and alkaloid degradation pattern during growth and specific growth conditions.

| Sample Description | Viable Count (cells/ml) ($X10^6$) | Alkaloid (mg/ml) | pH | Dissolved Oxygen (% Relative) |
|---|---|---|---|---|
| Before Inoculation | — | 2.46 | 6.0 | 56 |
| Inoculum | 2,600 | 0.07 | 7.5 | — |
| After inoculaton | 72 | 2.17 | 7.0 | 56 |
| 1 hour after | 116 | 1.99 | 7.0 | 58 |
| 2 hours after | 410 | 1.84 | 7.0 | 55 |
| 3 hours after | 560 | 1.83 | 7.1 | 52 |
| 4 hours after | 1,230 | 1.84 | 7.1 | 40 |
| 4.5 hours after | — | — | — | — |
| 5 hours after | 1,760 | 1.62 | 7.3 | 20 |
| 5.5 hours after | 3,400 | 1.27 | 7.4 | 22 |
| 6 hours after | 3,000 | 0.72 | 7.4 | 8 |
| 6.5 hours after | — | — | 7.4 | 40 |
| 7 hours after | 5,700 | 0.126 | 7.6 | 51 |

EXAMPLE 5

*P. putida* (NRRL B-8061) inoculum was prepared following the procedure of Example 4. To illustrate the effect of maximized culture activity, burley tobacco was treated with inoculum from the 8 liter culture at 0, 3.5, 5.75, 6 and 6.5 hours culture age. The treatment was accompanied by applying 30 mls of the culture to 10 gms of cut burley tobacco, mixing thoroughly, and immediately spreading the tobacco in a glass dish to dry at room conditions.

| | Culture Growth Alkaloid Decradation | | | Tobacco Treatment |
|---|---|---|---|---|
| Sampling Time | Cell Concentration ($\times 10^6$) | Alkaloid Content (mg/ml) | pH | Total Alkaloids Remaining in Burley Blend After Treatment (%) |
| Before inoculaion | — | 1.84 | 7.01 | |
| Inoculum | 1,160 | 0.10 | 7.7 | |
| 0 hrs. after inoc. | 43 | 1.77 | 7.08 | 3.01 |
| 1 hr. after inoc. | 52 | 1.68 | 7.01 | |
| 2 hrs. after inoc. | 111 | 1.65 | 7.00 | |
| 3 hrs. after inoc. | 500 | 1.56 | 7.14 | |
| 3.5 hrs. after inoc. | — | — | — | 2.92 |
| 4 hrs. after inoc. | 1,040 | 1.26 | 7.55 | |
| 5 hrs. after inoc. | 1,900 | 0.97 | 7.53 | |
| 5.75 hrs. after inoc. | — | — | — | 1.39 |
| 6 hrs. after inoc. | 3,100 | 0.19 | 7.66 | 0.87 |
| 6.5 hrs. after inoc. | — | — | — | 0.90 |
| 7 hrs. after inoc. | 5,600 | 0.19 | 7.85 | |

GROWTH CONDITIONS:

Medium: 8 liters burley extract broth (sterilized) in 14 liter fermentor jar

Agitation: 600 rpm—drive shaft having 2 turbine impellers

Aeration: 8,000 cc air/min.—(Single orifice sparger)

Temperature: 30° C.

Inoculum rate: 5% (v/v)

Antifoam: P-1200 (Dow)

pH Control: (New Brunswick Scientific pH controller Model No. PH 22) using two normal sodium hydroxide and two normal hydrochloric acid.

EXAMPLE 6

A burley strip blend was prepared and divided into 5 samples for various treatments. These treatments included: (I) cased, control, (II) mild nicotine degradation, no casing, (III) extended nicotine degradation, no casing, (IV) mild nicotine degradation with casing (casing added with inoculum), and (V) mild nicotine degradation, dried, cased and redried. Burley strip blend was weighed into 6 to 16 lb samples depending upon the treatment. Casing (sugars, etc.) was added at the rate of 47.4% of the tobacco weight at 13% moisture content.

*P. putida* (NRRL B-8061) inoculum was prepared as described in Example 4. The inoculum rate for all treatments was equal to 2 times the tobacco dry weight. As required, tap water was added to the inoculum or inoculum/casing mixture to give the desired target moisture (75.0%). Inoculum and/or casing were applied to the tobacco by spraying.

After inoculation, the tobacco was spread 4–6 inches deep and covered with polyethylene film to prevent excessive moisture loss. The tobacco was bulked, at approximately 78° F., for 3 to 19 hours, in accordance with the treatment schedule shown below.

| Cells/Gram Dry Wt. Tobacco ($\times 10^9$) | TREATMENTS I | II | III | IV | V |
|---|---|---|---|---|---|
| After Spray | | | 4.6 | | |
| 1 hr. | | 3.5 | | 4.0 | 3.5 |
| 3 hrs. | | 2.8 | | 4.1 | 2.8 |
| 5 hrs. | | | 6.4 | | |
| 19 hrs. | | | 17.5 | | |
| Bulking Time (hrs.) | 0 | 3 | 19 | 3 | 3 |
| % Moisture: | | | | | |
| Target | | 75 | 75 | 75 | 75 |
| Actual | | 73.1 | 71.7 | 71.6 | 73.1 |

At completion of the treatment, the treated burley tobaccos had the following properties:

| | AFTER TREATMENT | | | | |
|---|---|---|---|---|---|
| Total Alkaloids (%) | 2.47 | 2.13 | 0.76 | 1.98 | 1.68 |
| Reducing Sugar | 12.0 | 1.0 | 1.0 | 10.7 | 11.6 |
| Tobacco pH | — | 7.0 | 8.3 | 6.2 | 7.0 |

Those skilled in the art will visualize that many modifications and variations may be made in the invention set forth without departing from its spirit and scope. Accordingly, it is understood that the invention is not confined to the specifics set forth by way of illustration.

What is claimed is:

1. A smoking product containing tobacco treated by the process comprising:

a. contacting said tobacco with an aqueous medium containing at least $1\times10^7$ cells per gram based on the dry weight of said tobacco of a microorganism which degrades nicotine through a biochemical mechanism in which 3-succinoylpyridine is formed; and b. maintaining said tobacco in contact with said microorganism for from about 1 to about 10 hours at a moisture level of at least 50% by weight based on the total weight of tobacco and water, a temperature of from about 20° C. to about 45° C., and an initial pH of from about 5 to about 8;

the improvement comprising subjecting said tobacco to steam for a sufficient period of time to bring the moisture level of the tobacco to at least 15% by weight prior to contacting said tobacco with said aqueous medium.

2. The product of claim 1 wherein casing is mixed with the microorganism prior to inoculating the tobacco.

3. The product of claim 1 wherein said microorganism is elected from the group consisting of *Cellulomonas sp.* and *Pseudomonas putida.*

* * * * *